US006655147B2

(12) United States Patent
Farmer et al.

(10) Patent No.: US 6,655,147 B2
(45) Date of Patent: Dec. 2, 2003

(54) ANNULAR ONE-PIECE CORRUGATED LINER FOR COMBUSTOR OF A GAS TURBINE ENGINE

(75) Inventors: Gilbert Farmer, Cincinnati, OH (US); Shaun M. Devane, Cincinnati, OH (US); John L. Vandike, Fairfield, OH (US)

(73) Assignee: General Electric Company, Schenectady, NY (US)

( * ) Notice: Subject to any disclaimer, the term of this patent is extended or adjusted under 35 U.S.C. 154(b) by 35 days.

(21) Appl. No.: 10/119,649

(22) Filed: Apr. 10, 2002

(65) Prior Publication Data

US 2003/0192320 A1 Oct. 16, 2003

(51) Int. Cl.[7] ..... F02G 1/00; F02G 3/00

(52) U.S. Cl. ..... 60/752; 60/752; 60/754; 431/353; 431/350

(58) Field of Search ..... 60/752, 754; 431/353, 431/350

(56) References Cited

U.S. PATENT DOCUMENTS 3,398,527 A * 8/1968 Taylor et al. ..... 60/752
4,833,881 A * 5/1989 Vdoviak et al. ..... 60/762
4,930,729 A * 6/1990 Savill ..... 244/200
5,181,379 A 1/1993 Wakeman et al. ..... 60/261
5,233,828 A 8/1993 Napoli ..... 60/261
5,279,127 A 1/1994 Napoli ..... 60/754
5,363,654 A 11/1994 Lee ..... 60/752
5,460,002 A 10/1995 Correa ..... 60/723
5,465,572 A 11/1995 Nicoll et al. ..... 60/266
5,479,772 A * 1/1996 Halila ..... 60/800
5,483,794 A 1/1996 Nicoll et al. ..... 60/261

* cited by examiner

*Primary Examiner*—Justine R. Yu
*Assistant Examiner*—William H. Rodriguez
(74) *Attorney, Agent, or Firm*—William Scott Andes; James P. Davidson

(57) ABSTRACT

An annular one-piece liner for a combustor of a gas turbine engine, including a first end adjacent to an upstream end of the combustor, a second end adjacent to a downstream end of the combustor, and a plurality of corrugations between the first and second ends, each corrugation having an amplitude and a wavelength between an adjacent corrugation, wherein the amplitude of the corrugations and/or the wavelength between adjacent corrugations is variable from the first end to the second end.

31 Claims, 5 Drawing Sheets

ANNULAR ONE-PIECE CORRUGATED LINER FOR COMBUSTOR OF A GAS TURBINE ENGINE

BACKGROUND OF THE INVENTION

The present invention relates generally to a liner for the combustor of a gas turbine engine and, in particular, to an annular one-piece corrugated liner of substantially sinusoidal cross-section where the amplitude of the corrugations and/or the wavelength between adjacent corrugations is varied from an upstream end to a downstream end.

Combustor liners are generally used in the combustion section of a gas turbine engine located between the compressor and turbine sections of the engine, although such liners may also be used in the exhaust sections of aircraft engines that employ afterburners. Combustors generally include an exterior casing and an interior combustor where fuel is burned to produce a hot gas at an intensely high temperature (e.g., 3000° F. or even higher). To prevent this intense heat from damaging the combustor case and the surrounding engine before it exits to a turbine, a heat shield or combustor liner is provided in the interior of the combustor.

One type of liner design includes a number of annular sheet metal bands which are joined by brazing, where each band is subject to piercing operations after forming to incorporate nugget cooling holes and shaped dilution holes. Each band is then tack welded and brazed to the adjacent band, with stiffeners known as "belly bands" being tack welded and brazed to the sheet metal bands. The fabrication of this liner has been found to be labor intensive and difficult, principally due to the inefficiency of brazing steps applied to the stiffeners and sheet metal bands.

In order to eliminate the plurality of individual sheet metal bands, an annular one-piece sheet metal liner design has been developed as disclosed in U.S. Pat. No. 5,181,379 to Wakeman et al., U.S. No. Pat. 5,233,828 to Napoli, U.S. No. Pat. 5,279,127 to Napoli, U.S. No. Pat. 5,465,572 to Nicoll et al., and U.S. No. Pat. 5,483,794 to Nicoll et al. While each of these patents is primarily concerned with various cooling aspects of the one-piece liner, it will be noted that alternative configurations for such liners are disclosed as being corrugated so as to form a wavy wall. In this way, the buckling resistance and restriction of liner deflection for such liners is improved. The corrugations preferably take on a shallow sine wave form, but the amplitude of each corrugation (wave) and the wavelength between adjacent corrugations (waves) is shown and described as being substantially uniform across the axial length of the liner.

It has been determined that the stiffness requirements for a one-piece sheet metal liner are likely to vary across the axial length thereof since certain points will be weaker than others. Thus, it would be desirable for an annular, one-piece corrugated liner to be developed for use with a gas turbine engine combustor which provides a variable amount of stiffness along its axial length as required by the liner. It would also be desirable for such a liner to be manufactured and assembled more easily, including the manner in which it is attached at its upstream and downstream ends.

BRIEF SUMMARY OF THE INVENTION

In a first exemplary embodiment of the invention, an annular one-piece liner for a combustor of a gas turbine engine is disclosed as including a first end adjacent to an upstream end of the combustor, a second end adjacent to a downstream end of the combustor, and a plurality of corrugations between the first and second ends, each corrugation having an amplitude and a wavelength between an adjacent corrugation, wherein the amplitude of the corrugations is variable from the first end to the second end. The wavelengths between adjacent corrugations may be either substantially equal or variable from the first end to the second end of the liner.

In a second exemplary embodiment of the invention, an annular one-piece liner for a combustor of a gas turbine engine is disclosed as including a first end adjacent to an upstream end of the combustor, a second end adjacent to a downstream end of the combustor, and a plurality of corrugations between the first and second ends, each corrugation having an amplitude and a wavelength between an adjacent corrugation, wherein the wavelength between adjacent corrugations is variable from the first end to the second end. The amplitudes of each corrugation may be either substantially equal or variable from the first end to the second end of the liner.

DETAILED DESCRIPTION OF THE INVENTION

Figure 1:
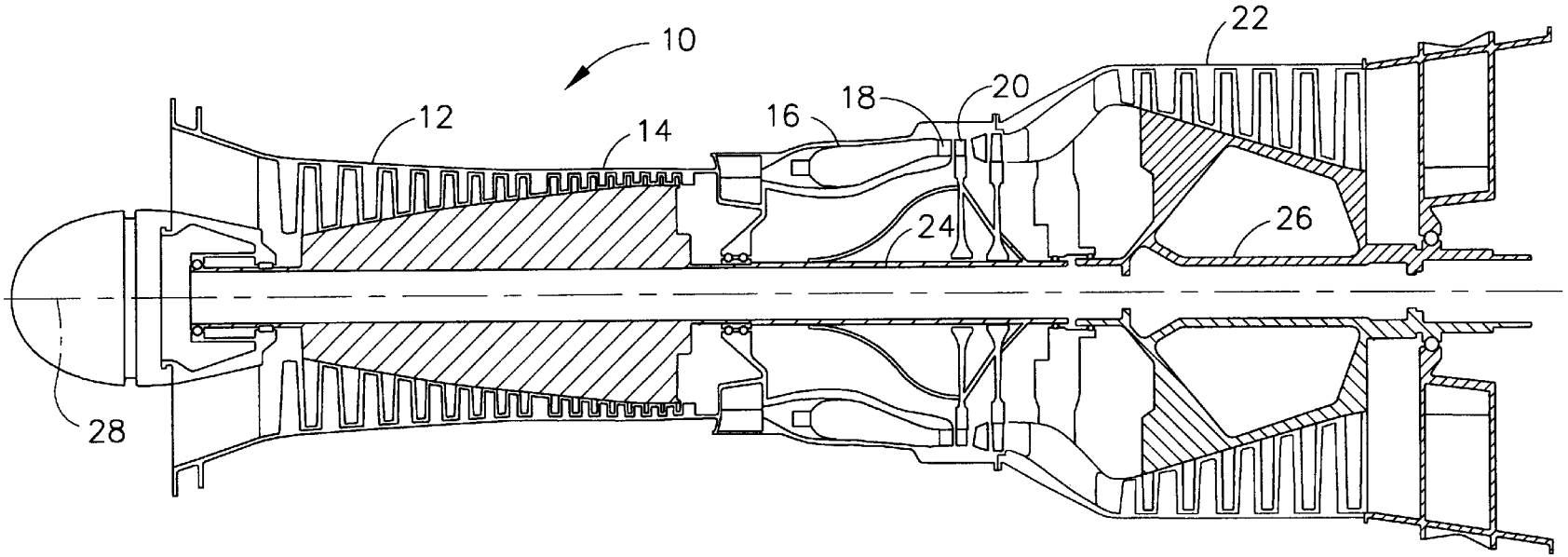
FIG. 1 is a cross-sectional view of a gas turbine engine including a combustor liner in accordance with the present invention.

Referring now to the drawings in detail, wherein identical numerals indicate the same elements throughout the figures, FIG. 1 depicts an exemplary gas turbine engine 10 having in serial flow communication a low pressure compressor 12, a high pressure compressor 14, and a combustor 16. Combustor 16 conventionally generates combustion gases that are discharged therefrom through a high pressure turbine nozzle assembly 18, from which the combustion gases are channeled to a conventional high pressure turbine 20 and, in turn, to a conventional low pressure turbine 22. High pressure turbine 20 drives high pressure compressor 14 through a suitable shaft 24, while low pressure turbine 22 drives low pressure compressor 12 through another suitable shaft 26, all disposed coaxially about a longitudinal or axial centerline axis 28.

Figure 2:
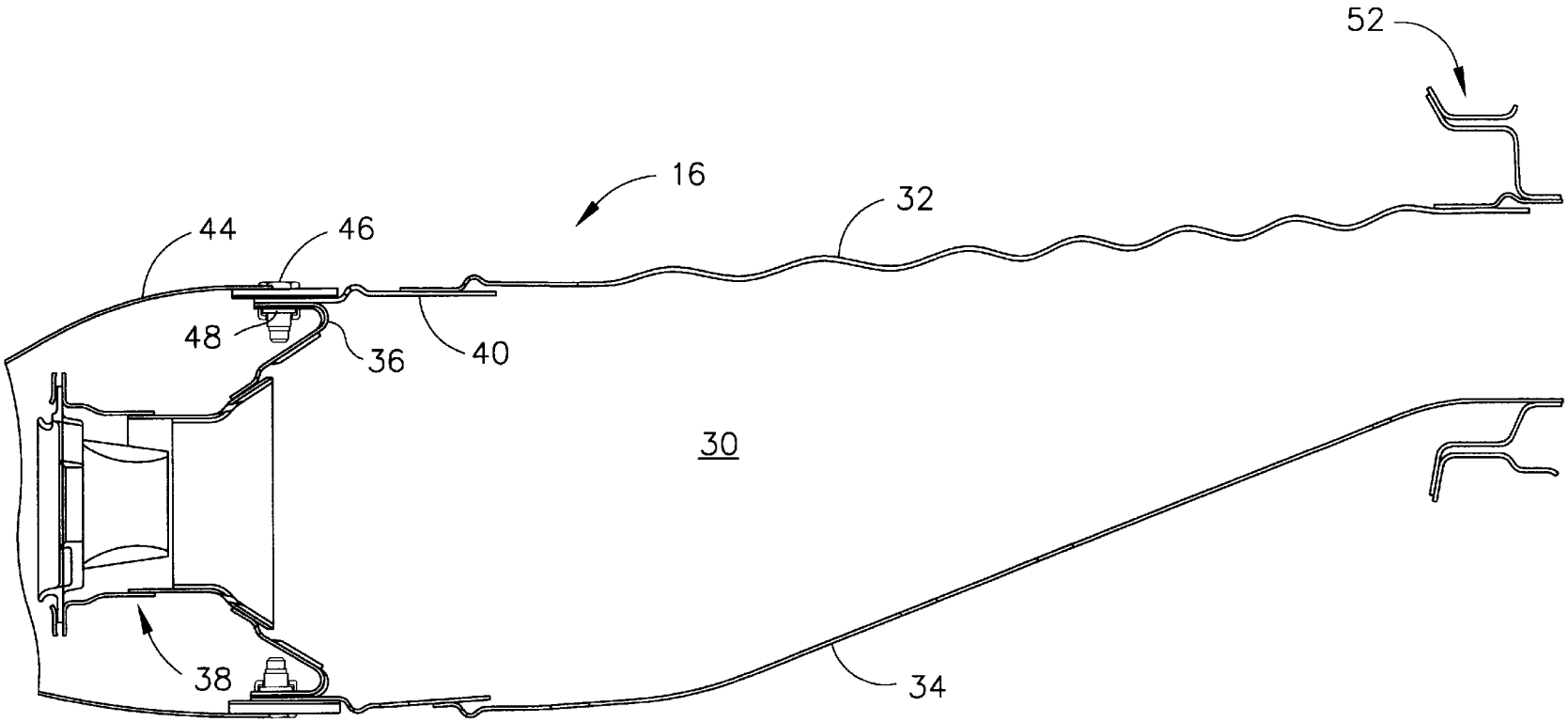
FIG. 2 is an enlarged, cross-sectional view of the combustor depicted in FIG. 1.

As seen in FIG. 2, combustor 16 further includes a combustion chamber 30 defined by an outer liner 32, an inner liner 34, and a dome 36 located at an upstream end thereof. It will be seen that a fuel/air mixer 38 is located within dome 36 so as to introduce a mixture of fuel and air into combustion chamber 30, where it is ignited by an igniter (not shown) and combustion gases are formed which are utilized to drive high pressure turbine 20 and low pressure turbine 22, respectively.

Figure 3:
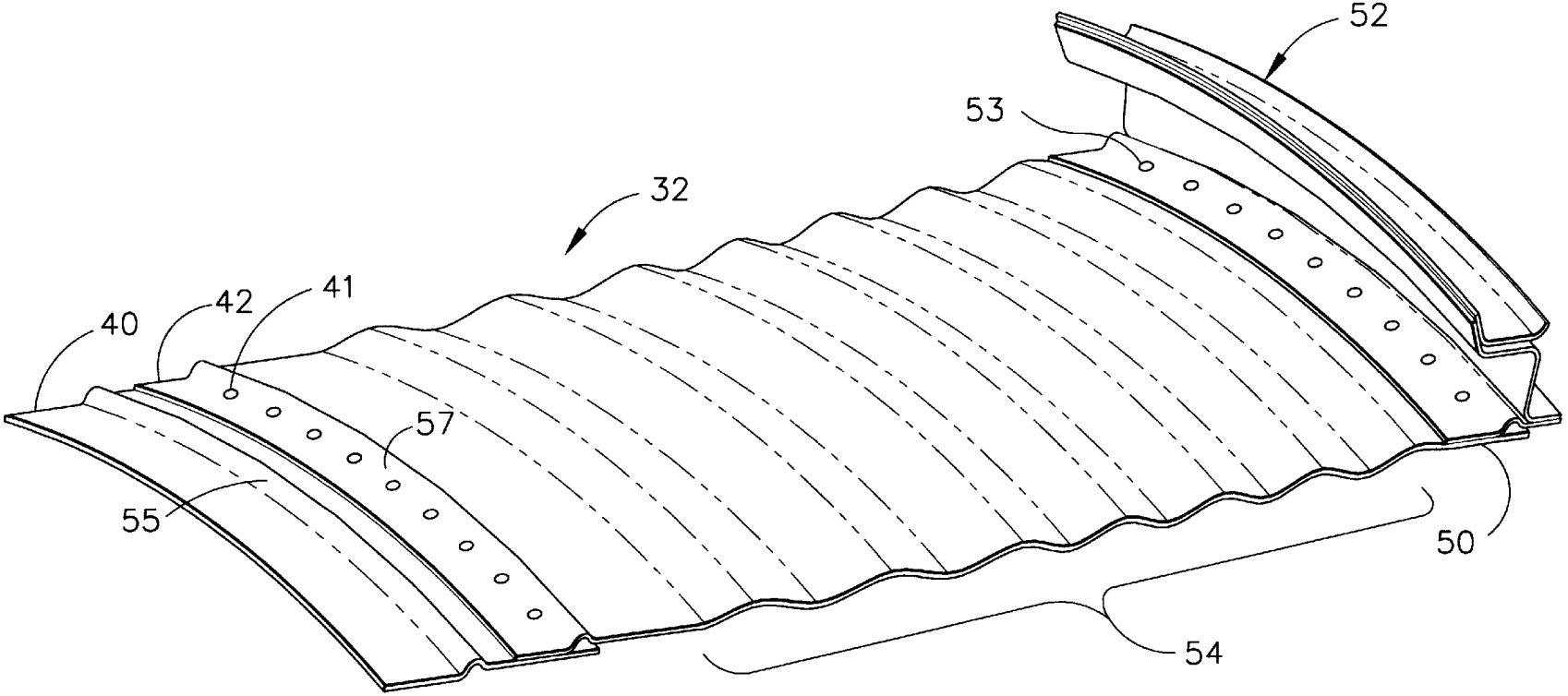
FIG. 3 is a partial perspective view of the outer liner for the combustor depicted in FIGS. 1 and 2 in accordance with the present invention.
Figure 4:
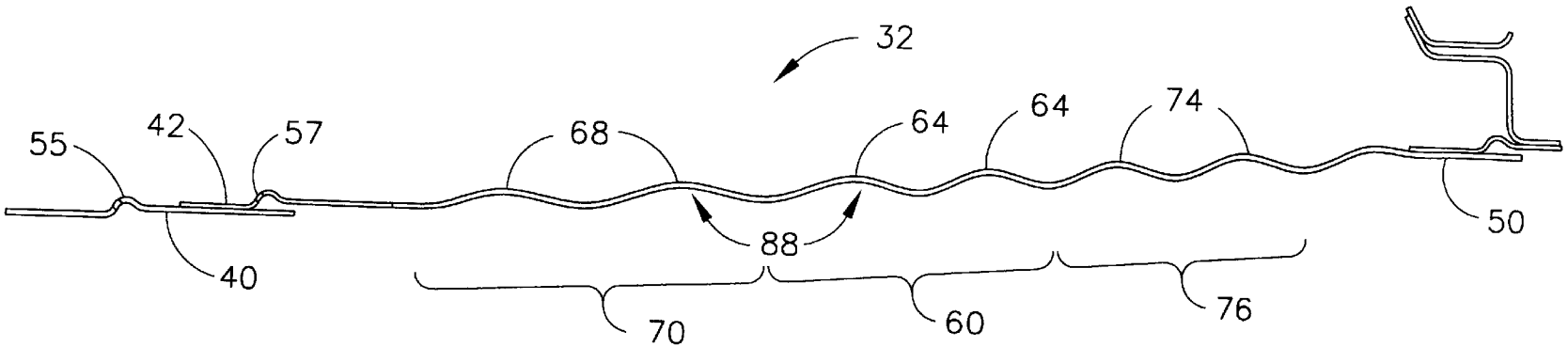
FIG. 4 is an enlarged cross-sectional view of the outer liner depicted in FIGS. 1–3.

In accordance with the present invention, it will be noted from FIGS. 3 and 4 that outer liner 32 is annular in shape and preferably formed as a one-piece construction from a type of sheet metal. More specifically, outer liner 32 includes a first end 42 located adjacent to an upstream end of combustor 16, where first end 42 is connected to a cowl 44 and dome 36 by means of a rivet band 40 (which is in turn connected to cowl 44 and dome 36 via a mechanical connection such as bolt 46 and nut 48, a welded connection, or other similar form of attachment). Accordingly, it will be appreciated that outer liner 32 is preferably connected to rivet band 40 via rivets 41 and therefore eliminates the need for outer liner 32 to have a flange formed thereon at upstream end 42. Starter slots 55 and 57 are preferably provided in rivet band 40 and upstream outer liner end 42, respectively, to promote a cooling film along the hot side of outer liner 32. Outer liner 32 also includes a second end 50 located adjacent to a downstream end of combustor 16, where second end 50 is preferably connected to a seal assembly 52 by means of rivets 53. In this way, outer liner 32 is able to move axially in accordance with any thermal growth and/or pressure fluctuations experienced.

Figure 5:
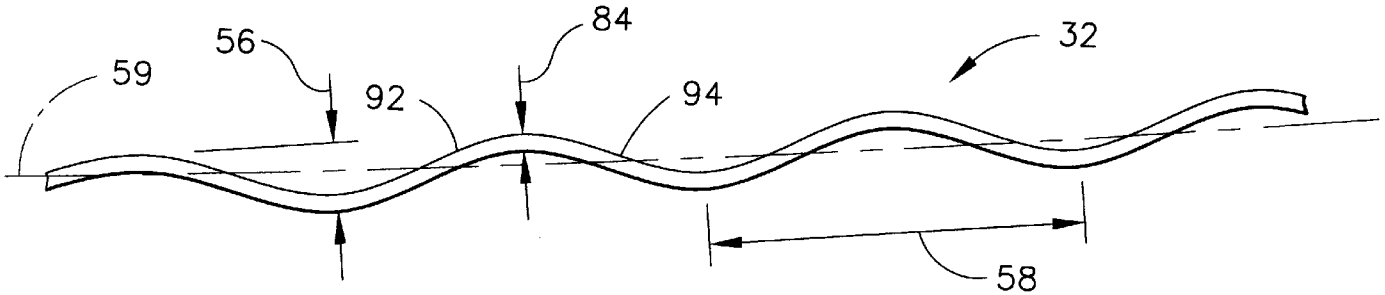
FIG. 5 is an enlarged, partial cross-sectional view of the outer liner depicted in FIG. 4, where the amplitude of the corrugations and the wavelength between adjacent corrugations is identified.

Outer liner 32 further includes a plurality of corrugations, identified generally by reference numeral 54 (see FIG. 3), formed therein between first end 42 and second end 50. It will be appreciated that corrugations 54 have a substantially sinusoidal shape when viewed in cross-section (see FIG. 4), as seen in accordance with a neutral axis 59 (see FIG. 5) extending therethrough. It will be appreciated from FIG. 5 that each corrugation 54 has a given amplitude 56, as well as a given wavelength 58 between adjacent corrugations 54. Contrary to the prior art, where the liners are disclosed as having corrugations with substantially the same amplitude and wavelength therebetween, corrugations 54 of outer liner 32 are configured so as to have a variable amplitude and/or a variable wavelength between adjacent corrugations. In this way, outer liner 32 is able to provide any degree of stiffness desired along various axial locations thereof without overdesigning outer liner 32 for its weakest points.

Figure 6:
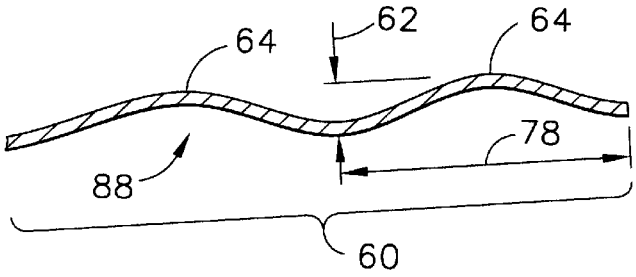
FIG. 6 is an enlarged, partial cross-sectional view of the middle section of the outer liner depicted in FIG. 4.
Figure 7:
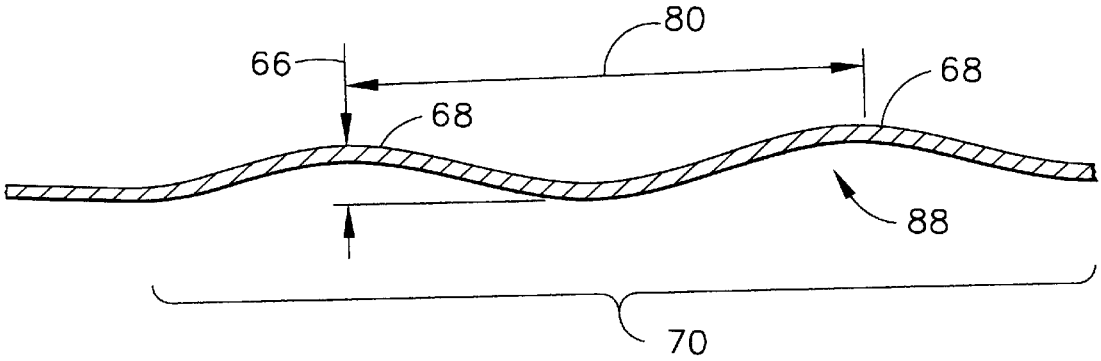
FIG. 7 is an enlarged, partial cross-sectional view of the upstream section of the outer liner depicted in FIG. 4; and, FIG. 8 is an enlarged, partial cross-sectional view of the downstream section of the outer liner depicted in FIG. 4.
Figure 8:
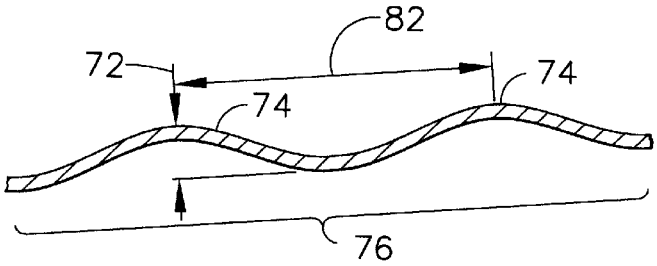

For example, it has been found that a middle section 60 of outer liner 32 is generally the weakest and most prone to buckling. Thus, an amplitude 62 for corrugations 64 located within middle section 60 (see FIG. 6) is preferably greater than an amplitude 66 for corrugations 68 located within an upstream section 70 (see FIG. 7) of outer liner 32 adjacent first outer liner end 42. Similarly, amplitude 62 for corrugations 64 located within middle section 60 is preferably greater than an amplitude 72 for corrugations 74 located within a downstream section 76 (see FIG. 8) of outer liner 32 adjacent second outer liner end 50. Since the fixed connection of outer liner 32 at first outer liner end 42 creates a slightly larger risk of buckling than at second outer liner end 50, and the temperature at first outer liner end 42 is generally higher than the temperature at second outer liner end 50, amplitude 66 for corrugations 68 is preferably equal to or greater than amplitude 72 for corrugations 74.

Either in conjunction with, or separately from, varying amplitudes 62, 66 and 72 for corrugations 64, 68 and 74 of middle section 60, upstream section 70 and downstream section 76, respectively, it has been found that varying the wavelengths between adjacent corrugations therein can also be utilized to tailor the stiffness of outer liner 32 at various axial locations. Accordingly, in the case where middle section 60 of outer liner 32 is considered to be most prone to buckling, a wavelength 78 between adjacent corrugations 64 is preferably less than a wavelength 80 between adjacent corrugations 68 of upstream section 70 and a wavelength 82 between adjacent corrugations 74 of downstream section 76. Likewise, wavelength 80 between adjacent corrugations 68 of upstream section 70 is preferably equal to or less than wavelength 82 between adjacent corrugations 74 of downstream section 76 for the aforementioned reasons with regard to their respective amplitudes.

In order to provide at least the same degree of stiffness as in current outer liners, it has been determined that an overall buckling margin of outer liner 32 preferably be in a range of approximately 35–250 psi. A more preferable overall buckling margin range for outer liner 32 would be approximately 85–200 psi, while an optimal range for such overall buckling margin would be approximately 120–180 psi.

Various configurations for outer liner 32 have been tested and analyzed, including the number of corrugations 54 formed therein, the thickness 84 thereof (see FIG. 5), and the material utilized to form such outer liner 32. It will be appreciated that the overall buckling margin discussed above is the overriding concern, but optimization of the other parameters involved is important since factors involving weight, cost, ability to form the material, and the like must be taken into account. Accordingly, it has been found that the total number of corrugations 54 (as defined by the total number of waves) formed in outer liner 32 preferably is approximately 6–12. The total number of corrugations 54 depicted within FIGS. 1–4 is 6½, which is shown only for exemplary purposes. The preferred thickness 84 for outer liner 32 preferably is approximately 0.030–0.080 inches when a sheet metal material (e.g., Hastelloy X, HS 188, HA 230, etc.) is utilized. In this way, the material can be easily formed with corrugations 54, provide the necessary stiffness, and reduce cost over previous liners.

With regard to the generation of a cooling flow along the hot (radially inner) side of outer liner 32, it is preferred that a multihole cooling pattern be formed therein like those described in U.S. No. Pat. 5,181,379, 5,233,828, and 5,465,572 be employed (i.e., regarding size, formation, etc.). It will be understood that the pattern of cooling holes may vary depending on their location with respect to a corrugation 54, the axial position along outer liner 32, the radial position along outer liner 32, the amplitude 56 for such corrugation, and the wavelength 58 for such corrugation. More specifically, a more dense multihole cooling pattern (spacing between cooling holes having a diameter of approximately 20 mil being approximately five diameters therebetween) is preferably utilized in those axial locations where the amplitude for a corrugation 54 is increased and/or the wavelength between adjacent corrugations is decreased. This stems from the need for more cooling air to be provided within a pocket 88 that is steeper and therefore less susceptible to the cooling flow from upstream outer liner end 42. A more dense multihole cooling pattern is also preferably provided on an upstream side 92 of corrugations 54 and adjacent the radial locations of fuel/air mixers 38. By contrast, a less dense multihole cooling pattern (spacing between cooling holes having a diameter of approximately 20 mil being approximately seven and one-half diameters therebetween) is preferably provided in those axial locations of outer liner 32 where the amplitude for a corrugation 54 is decreased and/or the wavelength between adjacent corrugations is increased. The less dense multihole cooling pattern is further preferred on a downstream side 94 of corrugations 54 and radial locations between adjacent fuel/air mixers 38.

Having shown and described the preferred embodiment of the present invention, further adaptations of outer liner 32 for combustor 16 can be accomplished by appropriate modifications by one of ordinary skill in the art without departing from the scope of the invention. In particular, it will be understood that the concepts described and claimed herein could be utilized in inner liner 34 and still be compatible with the present invention. While inner liner 34 typically will not require corrugations to be formed therein in order to satisfy stiffness requirements, it would be particularly useful for inner liner 34 to have a flangeless configuration that can be riveted at its upstream and downstream ends like that described for outer liner 32 as to simplify manufacturing and reduce cost.

What it claimed is:

1. An annular one-piece liner for a combustor of a gas turbine engine, comprising:

(a) a first end adjacent to an upstream end of said combustor;

(b) a second end adjacent to a downstream end of said combustor; and, (c) a plurality of corrugations between said first and second ends, each corrugation being substantially sinusoidal in cross-section and having an amplitude and a wavelength between an adjacent corrugation;

wherein the amplitude of said corrugations is variable from said first end to said second end.

2. The liner of claim 1, wherein the amplitude of each corrugation is formed in accordance with a stiffness requirement for said liner at such axial location thereof.

3. The liner of claim 1, wherein the amplitude of corrugations located within a middle section of said liner is greater than the amplitude of corrugations located within a section of said liner adjacent said first end.

4. The liner of claim 1, wherein the amplitude of corrugations located within a middle section of said liner is greater than the amplitude of corrugations located within a section of said liner adjacent said second end.

5. The liner of claim 1, wherein the amplitude of corrugations located within a section of said liner adjacent said first end is not less t the amplitude of corrugations located within a section of said liner adjacent said second end.

6. The liner of claim 1, wherein the wavelength between adjacent corrugations is variable from said first end to said second end.

7. The liner of claim 6, wherein the wavelength between corrugations located within a middle section of said liner is less than the wavelength between corrugations located within a section of said liner adjacent said first end.

8. The liner of claim 6, wherein the wavelength between corrugations located within a middle section of said liner is less than the wavelength between corrugations located within a section of said liner adjacent said second end.

9. The liner of claim 6, wherein the wavelength between corrugations located within a section of said liner adjacent said first end is not greater than the wavelength between corrugations located within a section of said liner adjacent said second end.

10. The liner of claim 1, wherein a buckling margin for said liner is in a range of approximately 35–250 psi.

11. The liner of claim 1, wherein a thickness of said liner is in a range of approximately 0.030–0.080 inches.

12. The liner of claim 1, wherein the total number of corrugations in said liner is in a range of approximately 6–12.

13. The liner of claim 1, wherein material utilized for said liner is among a group including HAST X, HS 188, and HA 230.

14. The liner of claim 1, further comprising a multihole cooling pattern formed in said liner such that a density for each corrugation is relative to the amplitude therefor.

15. The liner of claim 6, further comprising a multihole cooling pattern formed in said liner such that a density for each corrugation is relative to the wavelength between adjacent corrugations.

16. The liner of claim 1, wherein the wavelength between adjacent corrugations is substantially equal.

17. The liner of claim 1, wherein the liner is an outer liner for said combustor.

18. The liner of claim 1, wherein the liner is an inner liner for said combustor.

19. An annular one-piece liner for a combustor of a gas turbine engine, comprising:

(a) a first end adjacent to an upstream end of said combustor;

(b) a second end adjacent to a downstream end of said combustor; and, (c) a plurality of corrugations between said first aid second ends, each corrugation being substantially sinusoidal in cross-section and having an amplitude and a wavelength between an adjacent corrugation;

wherein the wavelength between adjacent corrugations is variable from said first end to said second end.

20. The liner of claim 19, wherein the wavelength between each adjacent pair of corrugations is formed in accordance with a stiffness requirement for said liner at such axial location thereof.

21. The liner of claim 19, wherein the wavelength between corrugations in a middle section of said liner is less than the wavelength between corrugations located in a section of said liner adjacent said first end.

22. The liner of claim 19, wherein the wavelength between corrugations in a middle section of said liner is less than the wavelength between corrugations located in a section of said liner adjacent said second end.

23. The liner of claim 19, wherein the wavelength between corrugations located in a section of said liner adjacent said first end is not greater than the wavelength between corrugations located in a section of said liner adjacent said second end.

24. The liner of claim 19, wherein a buckling margin for said liner is in a range of approximately 35–250 psi.

25. The liner of claim 19, wherein a thickness of said liner is in a range of approximately 0.030–0.080 inches.

26. The liner of claim 19, wherein the total number of corrugations in said liner is in a range of approximately 6–11.

27. The liner of claim 19, wherein material utilized for said liner is among a group including HAST X, HS 188, and HA 230.

28. The liner of claim 19, further comprising a multihole cooling pattern formed in said liner such that a density for each corrugation is relative to the wavelength between adjacent corrugations.

29. The liner of claim 19, wherein the amplitude for each corrugation is substantially equal.

30. The liner of claim 19, wherein the liner is an outer liner for said combustor.

31. The liner of claim 19, wherein the liner is an inner liner for said combustor.

* * * * *